US011577280B2

(12) United States Patent
Dickfeld

(10) Patent No.: US 11,577,280 B2
(45) Date of Patent: Feb. 14, 2023

(54) METHOD FOR SELECTIVELY SORTING OUT FLOWABLE PRODUCTS

(71) Applicant: Nils Dickfeld, Alsbach (DE)

(72) Inventor: Nils Dickfeld, Alsbach (DE)

( * ) Notice: Subject to any disclaimer, the term of this patent is extended or adjusted under 35 U.S.C. 154(b) by 0 days.

(21) Appl. No.: 17/270,290

(22) PCT Filed: Aug. 23, 2019

(86) PCT No.: PCT/EP2019/072630
§ 371 (c)(1),
(2) Date: May 11, 2021

(87) PCT Pub. No.: WO2020/039087
PCT Pub. Date: Feb. 27, 2020

(65) Prior Publication Data

US 2021/0252557 A1 Aug. 19, 2021

(30) Foreign Application Priority Data

Aug. 24, 2018 (DE) ..... 10 2018 120 721.2

(51) Int. Cl.
*B07C 5/36* (2006.01)
*B07B 4/02* (2006.01)
*B07C 5/342* (2006.01)

(52) U.S. Cl.
CPC ..... *B07C 5/366* (2013.01); *B07B 4/02* (2013.01); *B07C 5/342* (2013.01)

(58) Field of Classification Search
CPC ..... B07C 5/366; B07C 5/365; B07C 5/363; B07C 5/342; B07B 4/02; B25J 15/0616
See application file for complete search history.

(56) References Cited

U.S. PATENT DOCUMENTS 10,016,790 B1 * 7/2018 Travis ..... B07C 5/367

FOREIGN PATENT DOCUMENTS

CN 106000924 A * 10/2016
EP 2774693 A1 9/2014
(Continued)

OTHER PUBLICATIONS

Machine translation of CN-106000924-A (Year: 2016).*
International Search Report (Dec. 11, 2019) for corresponding International App. PCT/EP2019/072630.

*Primary Examiner* — Michael McCullough
*Assistant Examiner* — Jessica L Burkman
(74) *Attorney, Agent, or Firm* — WRB-IP LLP

(57) ABSTRACT

In a method for selectively sorting out free-flowing products (4) which are conveyed in a preferably groove-shaped conveying track (3) in a conveying direction (2) along a conveying path (1), the conveyed products (4) are checked by an inspection apparatus in an inspection portion of the conveying path (1). In a sorting-out portion arranged downstream along the conveying path (1), the product (4) that does not fulfil a predefinable inspection criterion is then sorted out and removed from the conveying track (3) by a suction device (8). To do this, the suction device (8) is arranged on the conveying path (1) and a suction flow that flows away from the conveying track (3) is generated for a predetermined suction duration in order to suction-off the product (4) out of the conveying track (3). According to the invention, it is provided that a suction tube (10) of the suction device (8) comprising a suction opening (9) is arranged at a front end (5) of the groove-shaped conveying track (3), in order to suction-off the product (2) that is falling from the conveying track (3) along a fall trajectory (6) at the front end (5) of the conveying track (3) through the suction opening (9).

10 Claims, 3 Drawing Sheets

(56) References Cited

FOREIGN PATENT DOCUMENTS

| | | | |
|---|---|---|---|
| JP | 6275911 | B1 | 2/2018 |
| WO | 2019069742 | A1 | 4/2019 |

* cited by examiner

METHOD FOR SELECTIVELY SORTING OUT FLOWABLE PRODUCTS

BACKGROUND AND SUMMARY

The invention relates, according to an aspect thereof, to a method for selectively sorting out free-flowing products which are conveyed in a conveying track in a conveying direction along a conveying path, wherein the conveyed products are checked by an inspection apparatus in an inspection portion of the conveying path, and wherein in a sorting-out portion arranged downstream along the conveying path, the product that does not fulfil a predefinable inspection criterion is sorted out and removed from the conveying track by a suction device, by the suction device being arranged on the conveying path and a suction flow that flows away from the conveying track being generated for a predetermined suction duration in order to suction the product out of the conveying track.

Various applications are known from practice in which free-flowing products are conveyed along a conveying path during production or when they are being packed into packaging. In many cases, the products are first singulated in order to be conveyed in succession in the conveying direction in a conveying track, which is usually formed by a groove-shaped indentation. In this case, the conveying track may be designed as a vibrating conveyor, for example, in order to convey the products located in the conveying track in the conveying direction over the conveying path by means of a continuous, directed vibrating motion. One field of application of this kind of conveying of products that is very relevant to the pharmaceutical industry in particular is singularization and conveying individual tablets or capsules during a production method or when packaging the tablets or capsules into containers, such as bottles or cardboard boxes.

In order to prevent damaged or defective products from continuing to be conveyed and from possibly being filled into packaging, it is known from practice that, using suitable methods, the products that do not fulfil a predetermined inspection criterion are sorted out and removed from the conveying path. Therefore, the individual products can be detected by a camera, for example, and checked for visual deviations from a predetermined appearance. It is also conceivable for the weight of the individual products to be checked by means of the inspection apparatus. For many applications, it is expedient and advantageous to at least also carry out an inspection for impurities in the products, wherein the impurities may relate to the visual perception, a chemical composition or metal particles or dirt particles. If an individual product does not fulfil the predetermined inspection criterion, such as a predetermined appearance or a predetermined minimum weight, the product in question should be sorted out wherever possible, so that it does not continue to be processed and possibly being packaged and shipped.

From practice, various methods for selectively sorting out products within a conveying path of this kind are known. Therefore, for example, products to be sorted out can be displaced from the conveying track by a targeted compressed air jet and can be excluded from being conveyed any further. It is likewise known to displace the products to be sorted out from the conveying track or from a predetermined conveying route and to exclude said products from being conveyed any further by means of suitable mechanical devices, such as flaps or movable discharge plates.

It has been proven in practice to suction the products to be sorted out from the conveying track by means of a suction device. For this purpose, a suction tube is usually guided to the product to be sorted out so as to be directly above or beside the conveying track and a suction flow that flows away from the conveying track, by means of which the product is suctioned out of the conveying track, is generated for a predetermined suction duration. The suctioned-off product can be fed to a storage container for sorted-off products through the suction tube. By contrast with blowing a defective product out of the conveying track, suctioning-off of the product by means of a suction device prevents the sorted-off products, or dust or contaminants therefrom, for example, from being more or less uncontrollably blown out of the conveying track.

It has, however, been found that, when suctioning-off a first product to be sorted out using a suction device arranged above the conveying track by means of the suction flow that is necessarily generated in the process, a subsequent second product in the conveying track is also seized by the suction flow and, as a result, is at least accelerated or is even likewise suctioned off, despite the subsequent second product in question not being defective. If the suction-off process is shortened in order to prevent an undesired impact on a subsequent second product or if the suction power used for generating the suction flow is reduced, the first product to be sorted out may often no longer be suctioned-off reliably.

It is desirable to configure a method for selectively sorting out free-flowing products according to the type mentioned at the outset in such a way, that a product to be sorted out can be sorted out as reliably as possible, with the intention being that a subsequent second product is impacted as little as possible.

According to an aspect of the invention, a suction tube of the suction device comprising a suction opening is arranged at a front end of the conveying track, in order to suction the product that is falling from the conveying track along a fall trajectory at the end of the conveying track through the suction opening. By contrast with the conventional methods, in which the suction device is arranged above the conveying track and the product to be sorted out is usually suctioned upwards by a suction tube, the suctioning-off in the method according to an aspect of the invention takes place at the front end of the conveying track, with the product to be sorted out not having to be suctioned out of the conveying track, but instead being able to be suctioned-off while falling along a fall trajectory. In this case, the fall trajectory corresponds to the flight path of a product that is falling undisturbed from the conveying track at the front end. Advantageously, the suction opening in the suction tube may be arranged below the upper face of the conveying track and optionally completely below the conveying track, such that a suction flow suctioned through the suction opening is not suction from the conveying track and a product subsequent to the product to be suctioned-off in the conveying track is not impacted. When the suction tube having the suction opening is arranged close to the front end of the conveying track, the product to be suctioned-off is at the start of its falling motion along the fall trajectory and is still comparatively slow, such that the falling product stays in a suction region around the suction opening in the suction tube for a relatively long period of time. Irrespective of the configuration and orientation of the conveying track, the suction tube may be arranged with its suction opening in the immediate vicinity of the fall trajectory of the falling product. The method according to an aspect of the invention may be particularly advantageously used with a groove-shaped conveying track.

According to an advantageous configuration of the concept of an aspect of the invention, it is provided that the suction tube having the suction opening is guided towards the front end of the conveying path before a suction-off process and is arranged with the suction opening in or directly on the fall trajectory of the falling product in order to suction-off the sorted-out product while it is falling along the fall trajectory, and that the suction tube having the suction opening is moved away from the front end of the conveying track after a suction-off process in order not to prevent a subsequent product in the conveying path that is not intended to be sorted out from falling along the fall trajectory. The suction tube can be moved, with the suction opening, directly into the fall trajectory of the falling product, such that even a low suction power is sufficient to suction the falling product through the suction opening into the suction tube. Here, the suction opening can be arranged and oriented such that the fall trajectory of the falling product extends through a cross-sectional area of the suction opening that is as large as possible and is directed perpendicularly to the fall trajectory. It may also be expedient for a suction portion of the suction tube adjacent to the suction opening to have a small angle of less than 45° and preferably of less than 20° relative to the fall trajectory of the falling product, such that a suction flow suctioned through the suction opening extends substantially in parallel with the fall trajectory and the product that is falling along the fall trajectory is already moving towards the suction opening during its falling motion. In this process, the suction flow assists the falling product in being collected by the suction opening in the suction tube and in the suctioned product being subsequently removed through the suction tube.

By optionally displacing the suction tube towards the fall trajectory or even into the fall trajectory and by subsequently moving the suction tube away in order not to disrupt the fall of a subsequent product, defective products that do not fulfil a predetermined inspection criterion can be sorted out in a particularly reliable manner.

According to an particularly advantageous configuration of the concept of an aspect of the invention, it is provided that a collection device, adjacent to the suction opening, for the product to be sorted out is arranged on the suction tube, and that the collection device is arranged in the fall trajectory before a suction-off process in order to collect the falling product by means of the collection device, and that the product collected by the collection device is then suctioned-off through the suction opening. In this process, a suction flow suctioning-off the product is generated before the falling product can be collected by the collection device and can additionally suction the falling product towards the collection device. It is likewise conceivable for the suction flow suctioning-off the product to only be generated when the product has already been collected by the collection device. In this case, a subsequent product can be largely or completely prevented from being impaired in an undesired manner when the product to be sorted out is being suctioned off. By means of the collection device, the suction flow required for suctioning-off the product or a minimum required suction power of the suction device can be reduced, since the suction flow is not used and required for deflecting the falling product out of the fall trajectory, but instead is only required for subsequently conveying the product that has already been collected out of the collection device through the suction tube.

The collection device may be a separately produced collection tray, which is fastened to the suction tube in the region of the suction opening such that an air flow suctioned through the suction opening can suction-off the product collected by the collection device out of the collection device through the suction tube. The collection device may also be a collection trough or collection tray formed on the suction tube. The collection device may also comprise a collection region encased with an air-permeable material. The collection region may for example be formed by a grating, a net, or a textile material, such that an air flow suctioned through the suction opening can also flow through the collection region of the collection device.

According to an optional configuration of the concept of an aspect of the invention, it is provided that the collection device is moved relative to the suction opening after collecting the product to be sorted out in order to facilitate suctioning-off of the product through the suction opening. Therefore, the collection device may for example be folded towards the suction opening or may be pivoted or moved into an arrangement that almost completely covers the suction opening, in order to convey the product to be sorted out through the suction opening into the suction tube. In this process, it may additionally also be achieved that the product collected in the collection device during a subsequent movement of the suction tube can no longer fall out of the collection device.

It may be expedient for a suction portion of the suction tube adjacent to the suction opening to be oriented at an angle of less than 45°, preferably of less than 20°, relative to a horizontal plane during a suction-off process. A substantially horizontal orientation of the suction tube and therefore of the air flow suctioned through the suction opening into the suction tube may cause a comparatively strong deflection of the falling product from the fall trajectory. If the suction opening is arranged directly at the end of the conveying track, the air flow suctioned into the suction tube through the suction opening can be oriented such that it substantially coincides with the movement of the sorted-out product in the conveying direction along the conveying track and the movement of the product near the end of the conveying track is used to facilitate the product being sorted out while it is being suctioned-off by means of a suction flow oriented in the same direction.

According to an advantageous configuration of the concept of an aspect of the invention, it is provided that the suction opening in the suction tube of the suction device surrounds the front end of the conveying track at least in portions during the suction-off process. Here, the suction tube may have a shape adapted to the conveying track or to the front end of the conveying track in the region of the suction opening, such that the suction opening fits closely to the front end of the conveying track. The suction flow suctioned through the suction opening is then very effectively suctioned from the conveying track, such that a product located therein that is to be sorted out is reliably suctioned-off even with a low suction power. By the suction tube surrounding the front end of the conveying track at least in portions, the position of the suction opening relative to the front end of the conveying track can be particularly reliably predetermined by the suction tube contacting the front end of the conveying track. It is likewise possible to arrange the suction tube having the suction opening at a short distance from the front end of the conveying track. A small gap does not significantly impair suctioning-offofa product to be sorted out and may provide advantages in terms of design, for example. The suction opening comprising the suction portion adjacent to the suction opening may be guided towards the front end of the conveying track and positioned during the suction-off process at an angle from above or from below the conveying direction.

The invention also relates, according to an aspect thereof, to a device for selectively sorting out free-flowing products, comprising a conveying track that extends in a conveying direction as far as a front end of a conveying path, and comprising a suction device comprising a suction tube that opens into a suction opening. The conveying track may be groove-shaped here and may convey a plurality of products beside one another or may comprise only one narrow, groove-shaped indentation or a plurality of narrow, groove-shaped indentations, with just one row of products arranged one behind the other in the conveying direction being located in each groove-shaped indentation.

In conventional devices, in which a product is sorted out from a conveying path using a suction device, the suction tube having the suction opening is usually arranged directly above the conveying track in order to suction the product to be sorted out upwards from the conveying track before the product leaves the conveying path. It cannot be ruled out here that a subsequent product is influenced by means of the suction-off process using the suction device and, for example, the fall trajectory of the falling product is changed owing to its acceleration, such that reliable conveying and further processing of the product is put at risk.

According to an aspect of the invention, it is therefore provided that the suction tube is movably mounted at the front end of the conveying path such that the suction tube having the suction opening can be moved into or onto a fall trajectory of a product falling from the conveying track at the front end below an upper face of the conveying track and can be moved away from the fall trajectory after the suction-off process is completed. While falling from the front end of the conveying path, the product to be sorted out can be suctioned-off in a laterally or downwardly directed manner without the suction flow required for suctioning-off being able to influence a subsequent product on the conveying track. Here, the suction tube can be moved directly into the fall trajectory of the falling product, such that the product falling along the fall trajectory falls through the suction opening into the suction tube, and can be reliably sorted out as a result, even without a suction flow or already with a low suction flow. At the same time, by subsequently moving the suction tube away from the fall trajectory, it can be ensured that neither the suction tube itself nor a suction flow generated in the surroundings of the suction opening can influence and therefore disrupt the fall of a subsequent product.

According to a particularly advantageous configuration of the concept of an aspect of the invention, it is provided that a collection device, adjacent to the suction opening, for the product to be sorted out is arranged on the suction tube. The collection device expediently comprises a trough-shaped or tray-shaped collection region for the product to be sorted out. In this case, the collection device is expediently arranged in the fall trajectory of a falling product to be sorted out such that the product falls into the collection device without a suction flow and is collected by the collection device. By means of the suction flow, the collected product can then be suctioned-off from the collection device through the suction tube.

In order to suction-off the product that has already been collected in the collection device as advantageously and efficiently as possible, it may optionally be provided that the collection device comprises at least one air-permeable flow opening, through which a suction flow directed towards the suction opening in the suction tube can flow at least in part. The air-permeable flow opening may for example be formed by a grating, a net, or a textile material, which is arranged in a collection region of the collection device and is surrounded by a suitable frame.

BRIEF DESCRIPTION OF THE DRAWINGS

In the following, some exemplary embodiments of the invention which are found in the drawings are shown by way of example and are explained in greater detail. In the drawings.

DETAILED DESCRIPTION

Figure 1:
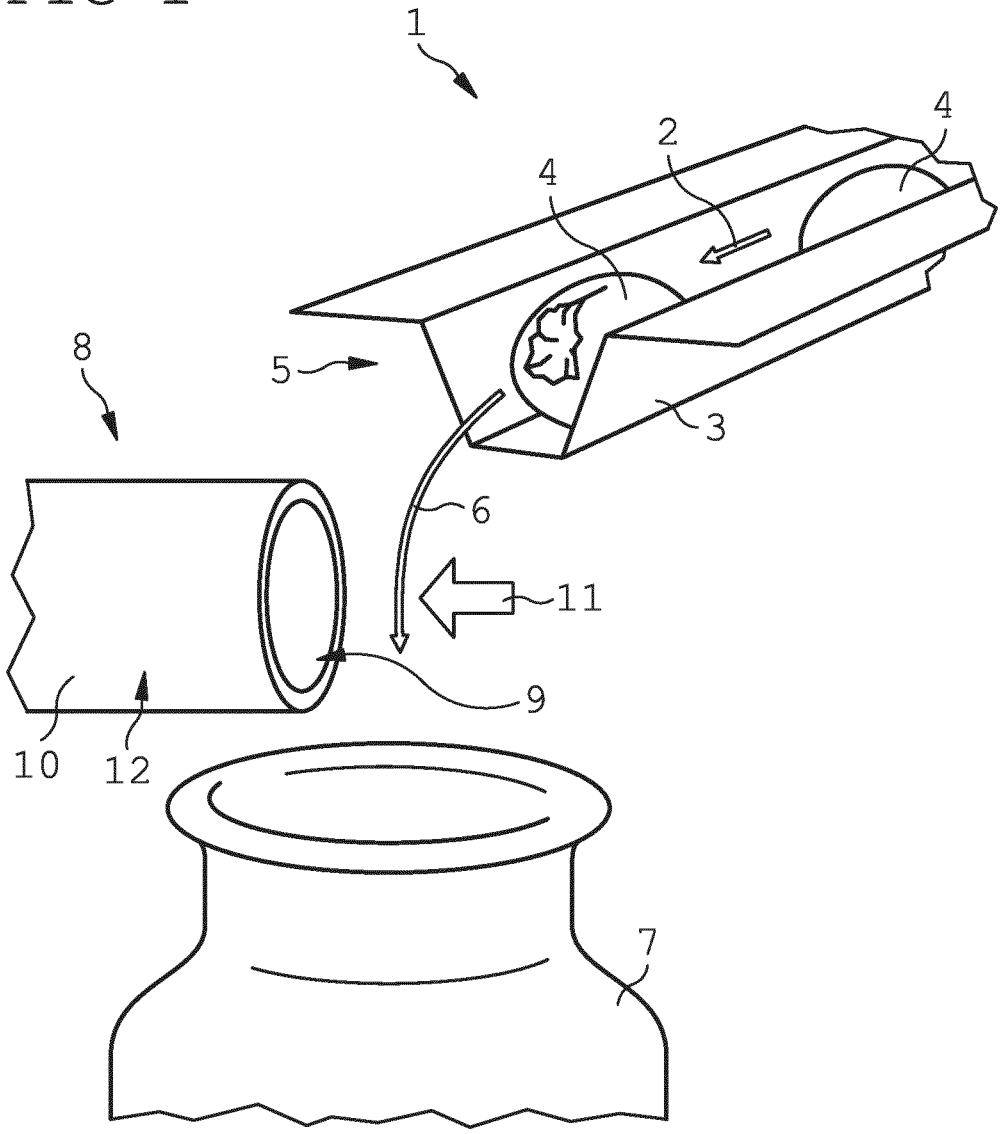
FIG. 1 is a schematic illustration of the sorting out according to the invention of a product while it is falling from a conveying path.

FIG. 1 schematically shows a conveying path 1 having a conveying track 3 oriented in a conveying direction 2. Two tablet-shaped products 4 are located in the conveying track 3, which are being conveyed in the conveying direction as far as a front end 5 of the conveying track 3. For this purpose, the conveying path 1 is designed as a vibrating conveyor, such that the products 4 are conveyed in the conveying track 3 in the conveying direction 2 as far as the front end 5 of the conveying track 3 by directed vibrating motions of the conveying path 1.

At the front end 5, the tablet-shaped products 4 fall out of the series of conveyor belts and downwards along a fall trajectory 6 into a packaging container 7 arranged below the front end 5 of the conveying track 3. Here, the fall trajectory 6 corresponds to a flight path of the products 4 which fall from the front end 5 of the conveying track 3 without any external influence and then fall downwards due to gravity.

At the side, a suction device 8 comprising a suction tube 10 that opens into a suction opening 9 is arranged in the immediate vicinity of the fall trajectory 6. In order to sort out a faulty product 4 before it reaches the packaging container 7, which product would otherwise be conveyed into the packaging container 7 by the conveying track 3, a negative pressure can be generated in the suction tube 10 by a negative-pressure-generating device (not shown) such that a suction flow 11 directed into the suction tube 10 is generated in a suction region in front of the suction opening 9. The suction tube 10 is arranged with its suction opening 9 on the fall trajectory 6 such that the suction flow 11 flows through the fall trajectory 6 and a product 4 falling along the fall trajectory 6 is seized by the suction flow 11 and is suctioned into the suction tube 10 through the suction opening 9.

Since the suction tube 10 comprising the suction opening 9 is arranged below the conveying track 3, any undesired impairment of a product 4 that is subsequent to the product 4 to be sorted out and is still located in the conveying track 3 is substantially ruled out.

Figure 2:
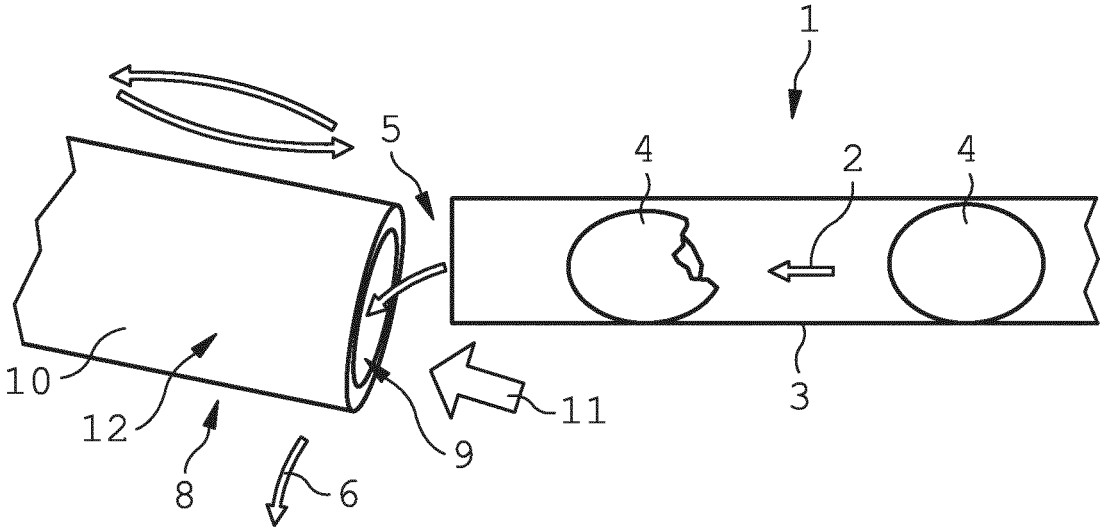
FIG. 2 is a schematic illustration of the suctioning-off of a product, shown in FIG. 1, at the front end of the conveying path, wherein a suction tube having a suction opening is arranged directly at the front end of a conveying track extending in the conveying path.

FIG. 2 schematically shows another variant of the method according to an aspect of the invention. The suction tube 10 comprising the suction opening 9 is guided towards the front end 5 of the conveying track 3 immediately before the start of a suction-off process and is arranged such that the fall trajectory 6 of a falling product 4 would pass through the suction opening 9. The product 4 to be sorted out is already conveyed towards the suction opening 9 while being conveyed in the conveying track 3. A suction portion 12 adjacent to the suction opening 9 has a small angle of less than 20° relative to a horizontal plane or relative to the orientation of the conveying track 3. When the suction tube 10 and the suction opening 9 are arranged in this way, just a low suction flow 11 having a comparatively low suction power is sufficient to suction the product 4 to be sorted out into the suction tube 10 through the suction opening 9 at the front end 5 of the conveying track 3 with assistance from the suction flow 11. Owing to the very low suction flow 11 having a low suction power in this configuration, any undesired influence on a subsequent product 4 can likewise be prevented.

Once the suction-off process for the product 4 to be sorted out is completed, the suction tube 10 comprising the suction opening 9 is removed from the front end 5 of the conveying track 3 again. The subsequent product 4 can then fall undisturbed along the fall trajectory 6 and can fall into a packaging container or a subsequent conveying path, for example.

Figure 3:
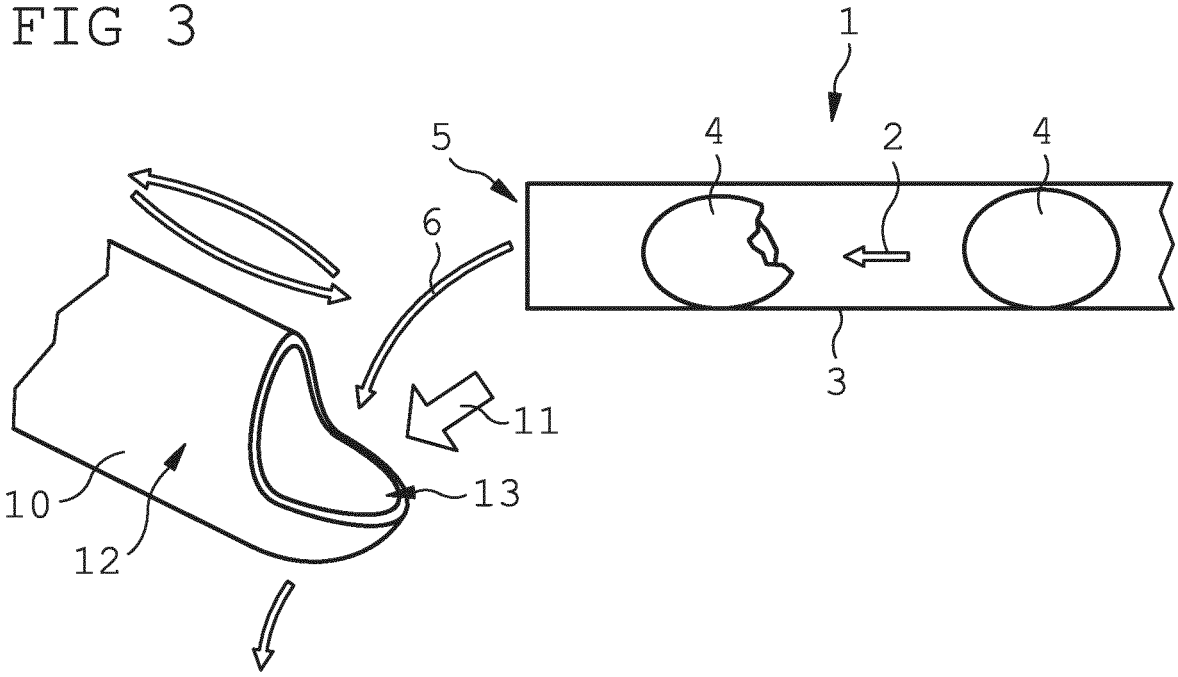
FIG. 3 shows a differently designed suction device, in which a collection device adjacent to the suction opening is formed on the suction tube.

FIG. 3 shows a differently designed suction device 8. A tray-shaped collection device 13, adjacent to the suction opening 9, is formed on the suction tube 10. The suction tube 10 can be arranged with the collection device 13 below the conveying track 3 such that the fall trajectory 6 leads into the collection device 13, or continues through the collection device 13. The product 4 falling along the fall trajectory 6 at the front end 5 then falls into the collection device 13 and can be suctioned through the suction tube 10 out of the collection device 13 with a suction flow 11 having a low suction power. In order to prevent products 4 that are not to be sorted out from being impaired or even sorted out when falling along the fall trajectory 6, the suction tube 10 comprising the collection device 13 has to be moved into the fall trajectory 6 immediately before the start of a sorting-out process and then has to be moved out of the fall trajectory 6 again. When using a suction device 8 comprising a collection device 13, the suction-off process can also start slightly later if the product 4 has already been collected by the collection device 13. Optionally, it is also possible for the suction-off process not to start until the suction tube 10 comprising the suction opening 9 and the collection device 13 has already been removed from the fall trajectory 6 again.

Figure 4:
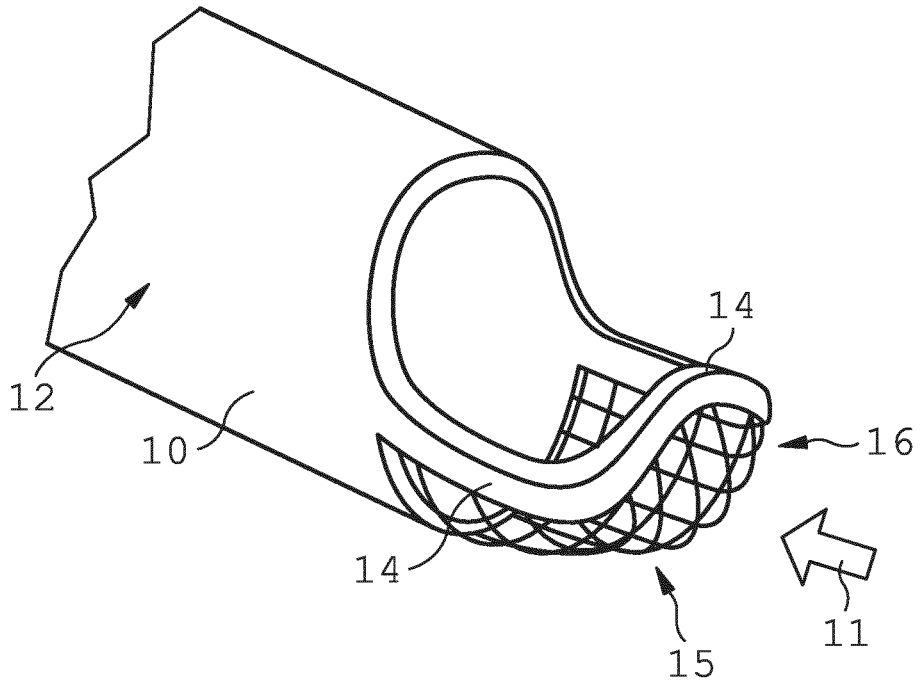
FIG. 4 shows a differently designed suction device comprising a collection device, which has an air-permeable flow effect.

FIG. 4 shows, by way of example, a differently designed collection device 13 on the suction tube 10. The collection device 13 comprises a grating 15 fixed to a frame 14, which grating forms an air-permeable flow opening 16. During the suction process, the suction flow 11 can be suctioned through the grating 15 and thus through the flow opening formed by the grating 15, such that the suction flow 11 can be suctioned into the suction tube 10 through the flow opening 16 virtually unimpeded and without turbulence. A product 4 lying on the grating 15 in the collection device 13 can be suctioned with a comparatively low suction power.

Figure 5:
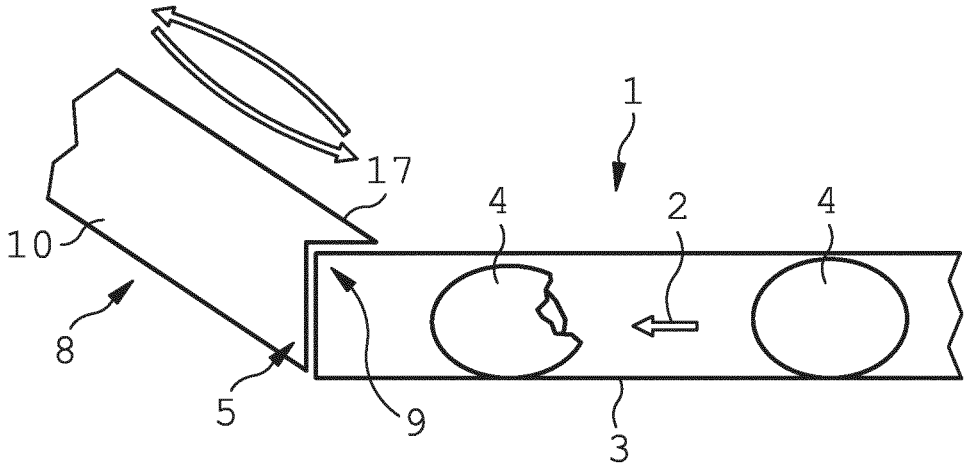
FIG. 5 is a schematic illustration of a differently designed suction device comprising a suction tube, which can be placed onto the front end of the conveying path in a form-fitting manner.

In the configuration of the suction device 8 shown by way of example in FIG. 5, the suction tube 10 has a shape that is adapted to the shape of the front end 5 of the conveying track 3 in the region of the suction opening 9. The majority of a cross-sectional area of the suction opening 9 covers the front end 5 of the conveying track 3. Only a small proportion of less than 20%, preferably less than 10%, of the cross-sectional area of the suction opening 9 projects laterally along the conveying track 3 and forms a stop surface 17, which can be used a guide and positioning aid during a movement of the suction tube 10 before and after a suction-off process.

The invention claimed is:

1. A method for selectively sorting out free-flowing products which are conveyed in a conveying track in a conveying direction along a conveying path, comprising checking the conveyed products by an inspection apparatus in an inspection portion of the conveying path, and sorting out and removing, by a suction device from the conveying track in a sorting-out portion arranged downstream along the conveying path, products that do not fulfil a predefinable inspection criterion, the suction device being arranged on the conveying path and a suction flow that flows away from the conveying track being generated for a predetermined suction duration in order to suction products that do not fulfil the predefinable inspection criterion out of the conveying track, wherein a suction tube of the suction device has a suction opening arranged at a front end of the conveying track in order to suction-off the products that do not fulfil the predefinable inspection criterion that fall from the conveying track along a fall trajectory at a front end of the conveying track through the suction opening.

2. The method according to claim 1, comprising guiding the suction tube towards the front end of the conveying path before a suction-off process and arranging the suction tube in or on the fall trajectory in order to suction-off the product to be sorted-out while it is falling along the fall trajectory, and moving the suction tube away from the front end of the conveying track after a suction-off process in order not to hinder the falling of a subsequent product in the conveying path that is not intended to be sorted out along the fall trajectory.

3. The method according to claim 1, wherein a collection device, adjacent to the suction opening, for the product to be sorted out is arranged on the suction tube, and the collection device is arranged in the fall trajectory before a suction-off process in order to collect the falling product by the collection device, and the product collected by the collection device is then suctioned-off through the suction opening.

4. The method according to claim 3, wherein the collection device is moved relative to the suction opening after collecting the product to be sorted out in order to facilitate suctioning-off of the product through the suction opening.

5. The method according to claim 1, wherein a suction portion of the suction tube adjacent to the suction opening is oriented at an angle of less than 45° relative to a horizontal plane during a suction-off process.

6. The method according to claim 1, wherein the suction opening of the suction tube of the suction device surrounds the front end of the conveying track at least in portions during the suction-off process.

7. A device for selectively sorting out free-flowing products, comprising a conveying track that extends in a conveying direction as far as a front end of a conveying path, and comprising a suction device comprising a suction tube that opens into a suction opening arranged to suction-off ones of the products that do not fulfil a predefinable inspection criterion from the conveying path, wherein the suction tube is movably mounted at the front end of the conveying path such that the suction tube comprising the suction opening can be moved into or onto a fall trajectory of a product falling from the conveying track at the front end below an upper face of the conveying track and can be moved away from the fall trajectory after a defective one of the products has been suctioned-off.

8. The device according to claim 7, wherein a collection device, adjacent to the suction opening, for the product to be sorted out is arranged on the suction tube.

9. The device according to claim 8, wherein the collection device comprises a trough-shaped or tray-shaped collection region for the product to be sorted out.

10. The device according to claim 8, wherein the collection device comprises at least one air-permeable flow opening, through which a suction flow directed towards the suction opening in the suction tube can flow at least in part.

* * * * *